US007148672B1

(12) United States Patent
Holmes

(10) Patent No.: US 7,148,672 B1
(45) Date of Patent: Dec. 12, 2006

(54) LOW-VOLTAGE BANDGAP REFERENCE CIRCUIT WITH STARTUP CONTROL

(75) Inventor: Steven L. Holmes, Sammamish, WA (US)

(73) Assignee: ZiLOG, Inc., San Jose, CA (US)

( * ) Notice: Subject to any disclaimer, the term of this patent is extended or adjusted under 35 U.S.C. 154(b) by 108 days.

(21) Appl. No.: 11/081,292

(22) Filed: Mar. 16, 2005

(51) Int. Cl.
*G05F 3/16* (2006.01)
*G05F 3/20* (2006.01)

(52) U.S. Cl. ..... 323/316; 323/315; 327/539

(58) Field of Classification Search ..... 323/316, 323/315, 314; 327/539
See application file for complete search history.

(56) References Cited

U.S. PATENT DOCUMENTS 5,629,611 A * 5/1997 McIntyre ..... 323/313
5,955,873 A * 9/1999 Maccarrone et al. ..... 323/314
6,005,374 A * 12/1999 Tasdighi ..... 323/273
6,724,176 B1 * 4/2004 Wong et al. ..... 323/316
6,933,770 B1 * 8/2005 Ranucci ..... 327/539
6,937,001 B1 * 8/2005 Ueda ..... 323/313
6,954,059 B1 * 10/2005 MacLean ..... 323/316
7,019,584 B1 * 3/2006 Bartel et al. ..... 327/539
7,071,767 B1 * 7/2006 Ou-yang et al. ..... 327/539
7,078,958 B1 * 7/2006 Gower et al. ..... 327/539
7,088,085 B1 * 8/2006 Marinca ..... 323/314

OTHER PUBLICATIONS

Hironori Bandba et al., "A CMOS Bandgap Reference Circuit With Sub-1-V Operation," article in IEEE Journal of Solid-State Circuits, vol. 34, No. 5, May 1999, pp. 670-674.

* cited by examiner

*Primary Examiner*—Bao Q. Vu
(74) *Attorney, Agent, or Firm*—Imperium Patent Works; Darien K. Wallace; T. Lester Wallace

(57) ABSTRACT

A bandgap reference circuit (BGRC) that is suitable for low-supply voltage applications outputs an adjustable reference voltage. In an operational mode, main currents flow through diodes and are controlled by a main current generator such that a positive temperature coefficient of a voltage across a resistor compensates for a negative temperature coefficient of a voltage across the diodes. The difference of the voltages across the diodes increases with temperature and is used to generate the main currents having positive temperature coefficients. The BGRC ensures sufficient current flow through the diodes during startup. In a startup mode, a startup current generator outputs startup currents that combine with the main currents and prevent the BGRC from operating at incorrect operating points that would otherwise be stable when insufficient current flows through the diodes. The startup currents are generated when the voltage drop across the resistor is less than a predetermined voltage offset.

21 Claims, 8 Drawing Sheets

(37) $V_A = \frac{kT}{q} \ln\left(\frac{I_{1A}}{I_S}\right)$ $I_{1A} = I_S e^{qV_A/kT}$

(38) $I_{2A} = 8I_S e^{qV_C/kT}$

(39) $I_{1A} = 6I_{2A}$ $I_S e^{qV_A/kT} = 48 I_S e^{qV_C/kT}$ $48 = e^{q(V_A - V_C)/kT}$ $V_A - V_C = \frac{kT}{q} \ln(48)$ $dV_F = I_{2A} \cdot R_3$ $dV_F = V_B - V_C$

(40) $V_A = V_B$ $dV_F = V_A - V_C$ $V_A - V_C = I_{2A} \cdot R_3$ $I_{2A} \cdot R_3 = \frac{kT}{q} \ln(48)$ $I_{2A} = \frac{kT}{q R_3} \ln(48)$ $V_B = I_{2B} \cdot R_2$

(40) $V_A = V_B$ $I_{2B} = \frac{V_A}{R_2}$

(37) $V_A = \frac{kT}{q} \ln\left(\frac{I_{1A}}{I_S}\right)$ $I_{2B} = \frac{kT}{q R_2} \ln\left(\frac{I_{1A}}{I_S}\right)$ $I_2 = I_{2A} + I_{2B}$ $I_2 = \frac{kT}{q R_3} \ln(48) + \frac{kT}{q R_2} \ln\left(\frac{I_{1A}}{I_S}\right)$ $V_{OUT} = I_3 \cdot R_4$

(41) $I_2 = I_3$ $V_{OUT} = I_2 \cdot R_4$ $V_{OUT} = \frac{kT R_4}{q R_3} \ln(48) + \frac{kT R_4}{q R_2} \ln\left(\frac{I_{1A}}{I_S}\right)$ $V_{OUT} = \frac{kT R_4}{q R_3} \ln(48) + \frac{V_A R_4}{R_2}$

(42) $\frac{dV_{OUT}}{dT} = \frac{kT R_4}{q R_3 T} \ln(48) + \frac{dV_A R_4}{R_2}$ $\frac{dV_{OUT}}{dT} = \frac{100\text{mV } R_4}{300°\text{K } R_3} - \frac{2\text{mV } R_4}{°\text{C } R_2}$ $\frac{dV_{OUT}}{dT} = 0$ $\frac{R_2}{R_3} = 6$

FIG. 4

LOW-VOLTAGE BANDGAP REFERENCE CIRCUIT WITH STARTUP CONTROL

TECHNICAL FIELD

The present invention relates generally to reference voltage circuits and, more specifically, to a bandgap reference circuit with a startup current generator that avoids incorrect operating points.

BACKGROUND

A conventional bandgap reference (BGR) circuit generates a reference voltage that remains constant with varying temperature. BGR circuits typically combine the negative temperature coefficient of the bandgap voltage of a transistor with the positive temperature coefficient of the voltage drop across a resistor with increasing current to achieve a zero overall temperature coefficient. The zero temperature coefficient typically occurs when the combined voltage drop across the transistor and resistor equals the silicon bandgap voltage of about 1.22 volts.

FIG. 1 (prior art) shows one conventional BGR circuit 10 that allows an output reference voltage ($V_{REF}$) to be adjusted to a voltage that is below the bandgap voltage of silicon. Moreover, BGR circuit 10 can operate with a supply voltage ($V_{CC}$) of less than 1 volt. BGR circuit 10 includes a single diode 11, a set of N diodes 12, a differential amplifier 13, a current mirror 14 and four resistors $R_1$, $R_2$, $R_3$ and $R_4$. Each of the diodes is a diode-connected CMOS transistor. Current mirror 14 includes three PMOS transistors $P_1$, $P_2$ and $P_3$ having the same dimensions. Because the gates of $P_1$, $P_2$ and $P_3$ are each connected to a common node with a voltage $V_1$, three equal currents $I_1$, $I_2$ and $I_3$ are generated.

The resistances of resistor $R_1$ and resistor $R_2$ are equal, and therefore a current $I_{1B}$ and a current $I_{2B}$ that flow through resistor $R_1$ and resistor $R_2$, respectively, are equal. Consequently, a current $I_{1A}$ and a current $I_{2A}$ are also equal. Current $I_{1A}$ flows through diode 11, and current $I_{2A}$ flows through resistor $R_3$ and diode set 12. $V_{F1}$ is the voltage drop across diode 11, $V_{F2}$ is the voltage drop across diode set 12, and $dV_F$ is the voltage drop across resistor $R_3$. Differential amplifier 13 operates to maintain two input voltages $V_A$ and $V_B$ at the same voltage. Therefore, $V_{F1}$ equals the sum of $V_{F2}$ plus $dV_F$. The negative temperature coefficient of $V_{F1}$ is compensated by the positive temperature coefficient of $dV_F$ with increasing current, and the voltage level of $V_A$ and $V_B$ remains stable over varying temperatures.

The output reference voltage $V_{REF}$ is generated using the mirrored current $I_3$ and the voltage drop across resistor $R_4$. The reference voltage $V_{REF}$ can therefore be adjusted by adjusting resistor $R_4$. The reference voltage $V_{REF}$ equals $R_4(V_{F1}/R_2+dV_F/R_3)$ and can be adjusted without changing the temperature coefficient of the bandgap, which is dependent on $R_2$ and $R_3$, where $R_1$ equals $R_2$.

FIG. 2 (prior art) shows the reference voltage $V_{REF}$ generated by BGR circuit 10 as a function of the supply voltage $V_{CC}$. The relationship between the supply voltage $V_{CC}$ and other voltages ($V_A$, $V_B$, $V_1$ and $V_S$) on nodes of BGR circuit 10 is also shown. FIG. 2 shows that a reference voltage significantly below the silicon bandgap voltage of 1.22 volts can be generated. For example, reference voltage $V_{REF}$ equals about 0.55 volts when the final operating point of voltages $V_A$ and $V_B$ is about 0.6 volts. For additional information on BGR circuit 10, see the journal article entitled "A CMOS Bandgap Reference Circuit with Sub-1-V Operation," by Hironori Banba et al., published in the IEEE Journal of Solid-State Circuits, Vol. 34, No. 5, May 1999, pages 670–674.

Under some conditions, however, BGR circuit 10 outputs a reference voltage the does not equal $R_4(V_{F1}/R_2+dV_F/R_3)$. As BGR circuit 10 is powered up, differential amplifier 13 can stabilize at incorrect operating points. Under these conditions, BGR circuit 10 outputs an inaccurate reference voltage that may lie significantly below the voltage defined by $R_4(V_{F1}/R_2+dV_F/R_3)$.

A method is sought for generating an adjustable bandgap reference voltage that is not rendered inaccurate due to stabilization at incorrect operating points.

SUMMARY

A bandgap reference (BGR) circuit outputs a reference voltage that can be adjusted below the bandgap voltage of silicon, allowing for low-supply voltage applications. The reference voltage can be adjusted without affecting the combined zero temperature coefficient of the circuit.

In an operational mode, two main currents that flow through diodes are controlled by a main control current generator such that a positive temperature coefficient of a voltage drop across a resistor compensates for a negative temperature coefficient of a voltage drop across the diodes. Although the diodes have negative temperature coefficients, the difference between the voltage drops across the diodes has a positive temperature coefficient. The difference of the voltages across the diodes increases with increasing temperature and is used to generate the two main currents having positive temperature coefficients.

As the BGR circuit biases up, the difference between the voltage drops across the diodes might not result in a positive temperature coefficient if insufficient current flows through the diodes. In a startup mode, a startup current generator therefore outputs two startup currents that combine with the two main currents and prevent the BGR circuit from operating at incorrect operating points that would otherwise be stable when insufficient current flows through the diodes. At an incorrect operating point, the BGR circuit would output an incorrect reference voltage. The startup currents are generated when the voltage drop across the resistor is less than a predetermined voltage offset. When the BGR circuit enters the operational mode, the voltage drop across the resistor exceeds the predetermined voltage offset and the startup current generator stops generating the startup currents.

Other embodiments and advantages are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

FIG. 4 is a diagram of equations showing the derivation of the relationship between resistors of the bandgap reference circuit of FIG. 3 that results in a combined temperature coefficient of zero.

FIG. 6 is a waveform diagram showing the response of various internal voltages of the bandgap reference circuit of FIG. 3 after power is turned on.

DETAILED DESCRIPTION

Reference will now be made in detail to some embodiments of the invention, examples of which are illustrated in the accompanying drawings.

Figure 1:
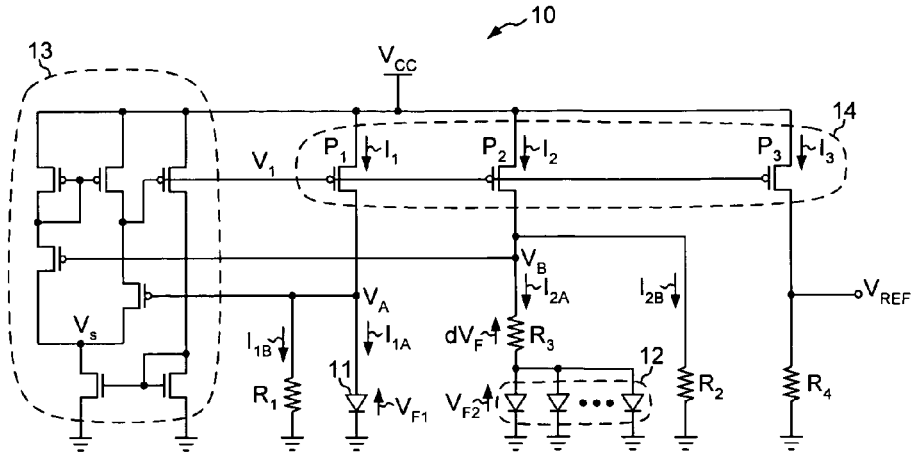
FIG. 1 (PRIOR ART)
FIG. 1 (prior art) is a simplified schematic diagram of a bandgap reference circuit that allows an output reference voltage to be adjusted to a voltage below the bandgap voltage of silicon.
Figure 2:
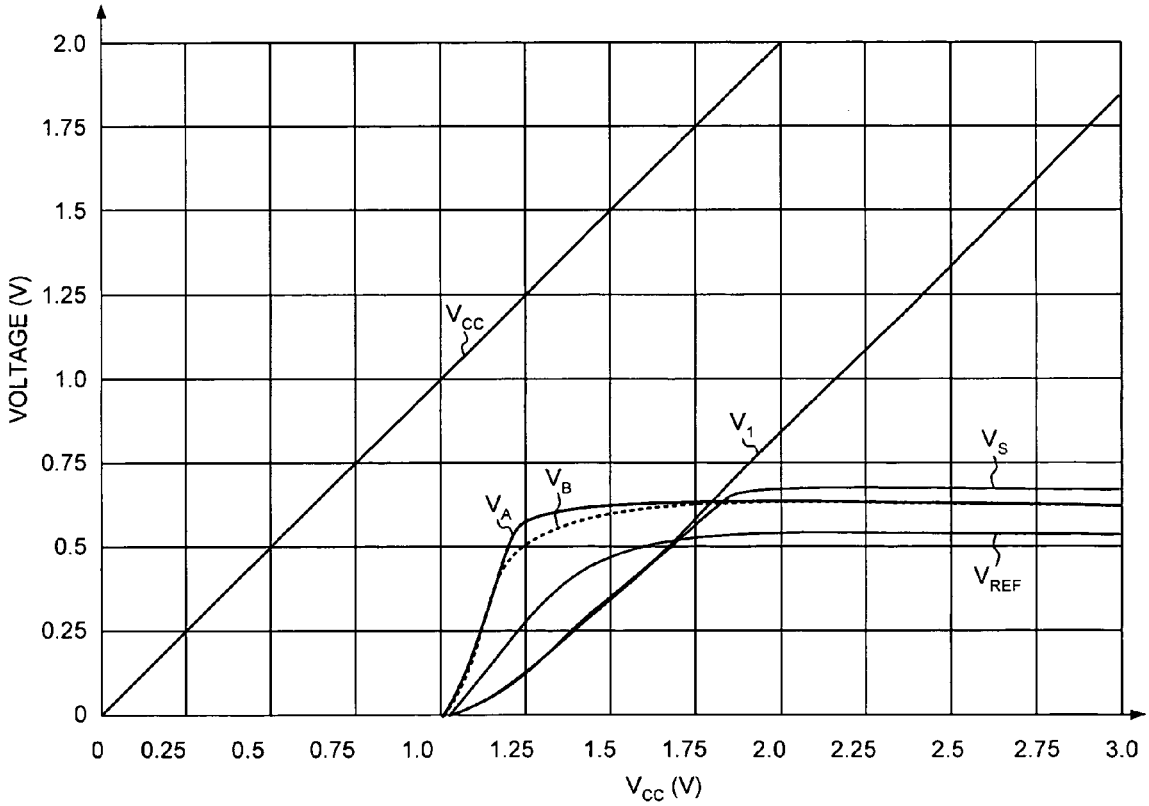
FIG. 2 (PRIOR ART)
FIG. 2 (prior art) is voltage waveform diagram illustrating the operation of the bandgap reference circuit of FIG. 1.
Figure 3:
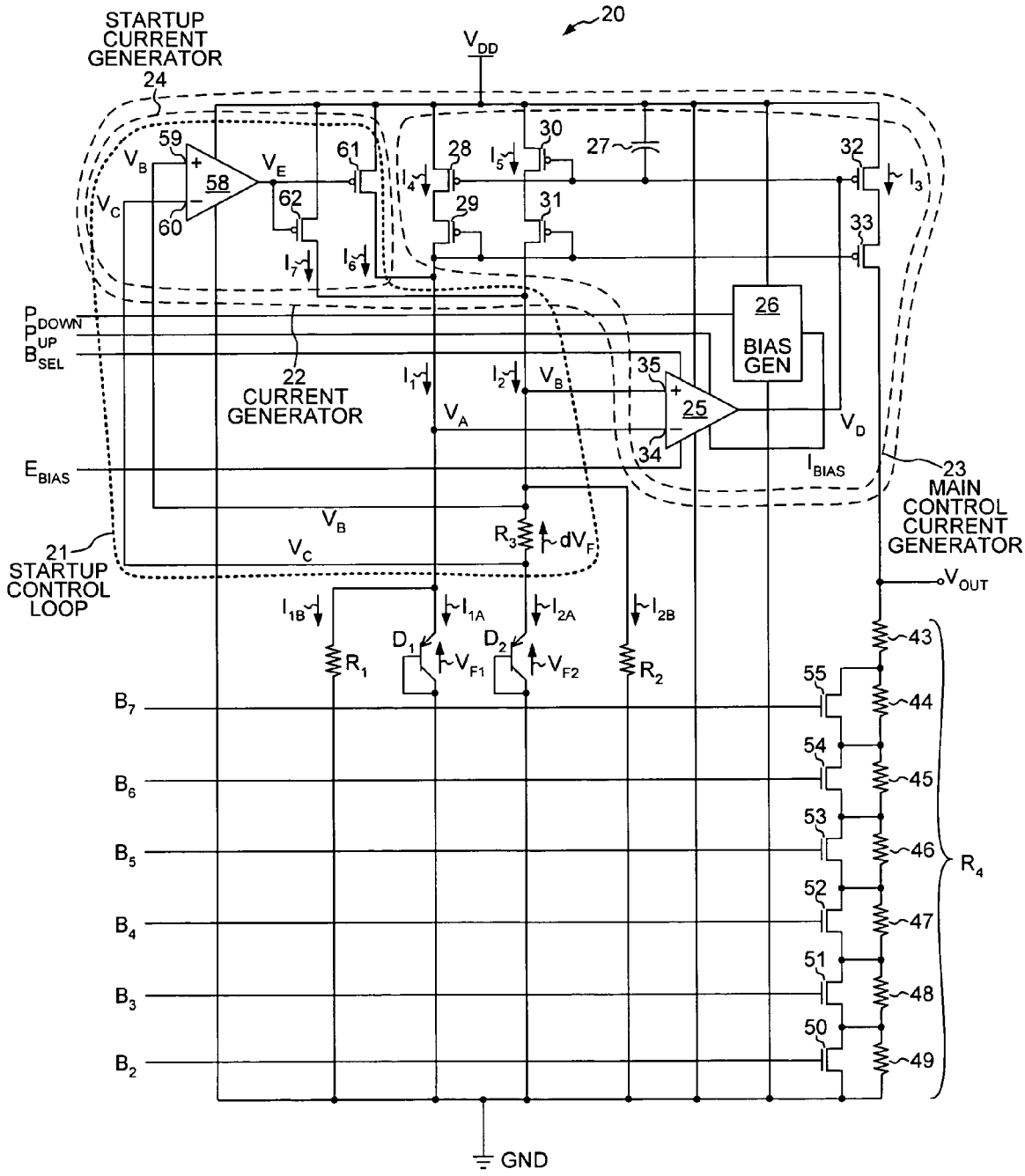
FIG. 3 is a schematic circuit diagram of a bandgap reference circuit with a startup control loop according to one embodiment of the invention.

FIG. 3 is a simplified schematic diagram of a bandgap reference (BGR) circuit 20 with a startup control loop 21 in which an output reference voltage $V_{OUT}$ can be adjusted without changing the combined temperature coefficient of the circuit. BGR circuit 20 includes a current generator 22, two diodes $D_1$ and $D_2$, and four resistors $R_1$, $R_2$, $R_3$ and $R_4$. Current generator 22 includes a main control current generator 23 and a startup current generator 24. Startup current generator 24 is part of startup control loop 21. Current generator 22 generates a first current $I_1$, a second current $I_2$ and a third current $I_3$.

In an operational mode, startup current generator 24 does not generate current, and currents $I_1$ and $I_2$ are substantially equal to a fourth current $I_4$ and a fifth current $I_5$, respectively. Fourth current $I_4$ and fifth current $I_5$ are generated by a current mirror that is part of main control current generator 23. In a startup mode, startup current generator 24 generates a sixth current $I_6$ and a seventh current $I_7$ that contribute to currents $I_1$ and $I_2$, respectively. Currents $I_6$ and $I_7$ prevent BGR circuit 20 from operating at incorrect operating points that would otherwise be stable when currents $I_4$ and $I_5$ are insufficient to flow through diodes $D_1$ and $D_2$.

First current $I_1$ is split into two current portions $I_{1A}$ and $I_{1B}$. Current portion $I_{1A}$ flows through first diode $D_1$, and current portion $I_{1B}$ flows through resistor $R_1$. Second current $I_2$ is split into two current portions $I_{2A}$ and $I_{2B}$. Current portion $I_{2A}$ flows through both resistor $R_3$ and second diode $D_2$. Current portion $I_{2B}$ flows through resistor $R_2$. Each of first diode $D_1$ and second diode $D_2$ is a diode-connected bipolar transistor. In this embodiment, second diode $D_2$ is eight times larger than first diode $D_1$, and resistor $R_2$ is six times larger than resistor $R_1$.

Main control current generator 23 includes an operational amplifier 25, a bias generator 26, a capacitor 27, and three cascode current sources. The three cascode current sources form the current mirror that generates third current $I_3$, fourth current $I_4$ and fifth current $I_5$. Six PMOS transistors 28–33 form the cascode current sources. Each cascode current source is a stack of two PMOS transistors that has a higher output impedance than would a single transistor. For example, transistors 32 and 33 generate third current $I_3$, whose magnitude varies less with changes in supply voltage $V_{DD}$ than would a current generated by transistor 32 alone. In this embodiment, the sizes of transistors 28–33 is such that fourth current $I_4$ is six times larger than fifth current $I_5$, and fifth current $I_5$ has the same magnitude as third current $I_3$. Other embodiments are configured such that fourth current $I_4$ is some other fixed multiple of fifth current $I_5$. In another embodiment, for example, fourth current $I_4$ is one times as large as fifth current $I_5$. In yet another embodiment, fourth current $I_4$ is one third as large as fifth current $I_5$.

In the operational mode when startup current generator 24 does not generate current, fourth current $I_4$ substantially equals first current $I_1$, and fifth current $I_5$ substantially equals second current $I_2$. An inverting input lead 34 of operational amplifier 25 is coupled to the anode of first diode $D_1$. A voltage $V_A$ is present on the anode of first diode $D_1$. A noninverting input lead 35 of operational amplifier 25 is coupled to resistor $R_3$. A voltage $V_B$ is present on noninverting input lead 35 of operational amplifier 25. Main control current generator 23 controls fourth current $I_4$ and fifth current $I_5$ in order to maintain voltage $V_A$ and voltage $V_B$ at the same level.

Diode $D_1$ and diode $D_2$ both have negative temperature coefficients. The voltage drop $V_F$ across the p-n junction of a diode is typically expressed by the equation $V_F=(kt/q)\ln(I_F/I_S)$, where k is Boltzmann's constant ($1.38\times10^{-23}$ CV/K) and q is the electronic charge ($1.6\times10^{-19}$ C) and where C is coulombs and K is degrees Kelvin. For each degree of temperature increase of a bipolar diode, the voltage drop across the p-n junction decreases by about two millivolts.

BGR circuit 20 compensates for the negative temperature coefficient of diodes $D_1$ and $D_2$ by generating a PTAT current (proportional to absolute temperature). Although both diodes $D_1$ and $D_2$ have negative temperature coefficients, the difference between the voltage drop ($V_{F1}$) across diode $D_1$ and the voltage drop ($V_{F2}$) across diode $D_2$ has a positive temperature coefficient. The difference in the bandgap voltages ($V_{F1}-V_{F2}$) is used to generate currents $I_1$ and $I_2$ that increase in magnitude with increasing temperature. The voltage drop ($dV_F$) across resistor $R_3$ increases proportionately to the increase in second current $I_2$, and consequently $dV_F$ has a positive temperature coefficient. Voltage drop $dV_F$ is the difference between voltage $V_B$ on one node of resistor $R_3$ and a voltage $V_C$ on the other node of resistor $R_3$. Voltage $V_C$ is also present on the anode of diode $D_2$. The magnitudes of the resistances of resistors $R_1$, $R_2$ and $R_3$ are adjusted such that the negative temperature coefficient of $V_{F2}$ across diode $D_2$ is offset by the positive temperature coefficient of $dV_F$ across resistor $R_3$. The positive temperature coefficient of the difference between the voltage drop $V_{F1}$ across diode $D_1$ and the voltage drop $V_{F2}$ across diode $D_2$ is achieved by flowing more current per diode area through first diode $D_1$. Approximately forty-eight times more current per diode area flows through first diode $D_1$ than through second diode $D_2$ because second diode $D_2$ is eight times larger than first diode $D_1$, first current $I_1$ is six times larger than second current $I_2$, and resistor $R_2$ is six times larger than resistor $R_1$.

FIG. 4 shows a derivation of the relationship between the resistances of resistors $R_1$, $R_2$ and $R_3$ that results in a combined temperature coefficient of zero for BGR circuit 20. A first equation 37 represents the voltage drop $V_{F1}$ across diode $D_1$. Because the cathode of diode $D_1$ is coupled to analog ground (GND), voltage drop $V_{F1}$ equals the voltage $V_A$ present on the anode of first diode $D_1$ and on inverting input lead 34 of operational amplifier 25. The current $I_{1A}$ through diode $D_1$ is expressed in terms of voltage $V_A$. Equation 38 indicates that diode $D_2$ is eight times larger than diode $D_1$. Equation 39 indicates that current $I_{1A}$ through diode $D_1$ is six times larger than current $I_{2B}$ through diode $D_2$ as a consequence of transistors 28 and 29 being six times larger than transistors 30 and 31. Equation 40 indicates that main control current generator 23 controls currents $I_4$ and $I_5$ to maintain voltages $V_A$ and $V_B$ at the same level. Equation 41 indicates that the current mirror formed by the cascode current sources generates third current $I_3$ and fifth current $I_5$ having equal magnitudes. Moreover, fifth current $I_5$ equals second current $I_2$ in the operational mode when startup current generator 24 does not generate current.

Equation 42 expresses the first derivative of the output reference voltage $V_{OUT}$ as a function of temperature. The change in reference voltage $V_{OUT}$ as a function of temperature is expressed as the sum of a positive temperature coefficient and a negative temperature coefficient. The contribution of the positive temperature coefficient depends on the magnitude of resistor $R_3$, and the contribution of the negative temperature coefficient depends on the magnitude of resistor $R_2$. Applying the standard accepted negative temperature coefficient of −2 mV for a bipolar bandgap results in a ratio of 6 for the relationship $R_2/R_3$ in order to achieve a zero temperature coefficient. In the embodiment of FIG. 3 based on a 0.35 micron TSMC SPICE simulation, a ratio of 5.76 for $R_2/R_3$ resulted in a zero temperature coefficient for BGR circuit 20. Thus, the output reference voltage $V_{OUT}$ can be set by adjusting the magnitude of resistor $R_4$ without disturbing the balance of positive and negative temperature coefficients. The ratios of $R_4/R_3$ and $R_4/R_2$ are independent of temperature changes because the resistors are all of the same type and manufactured in the same process.

Figure 5:
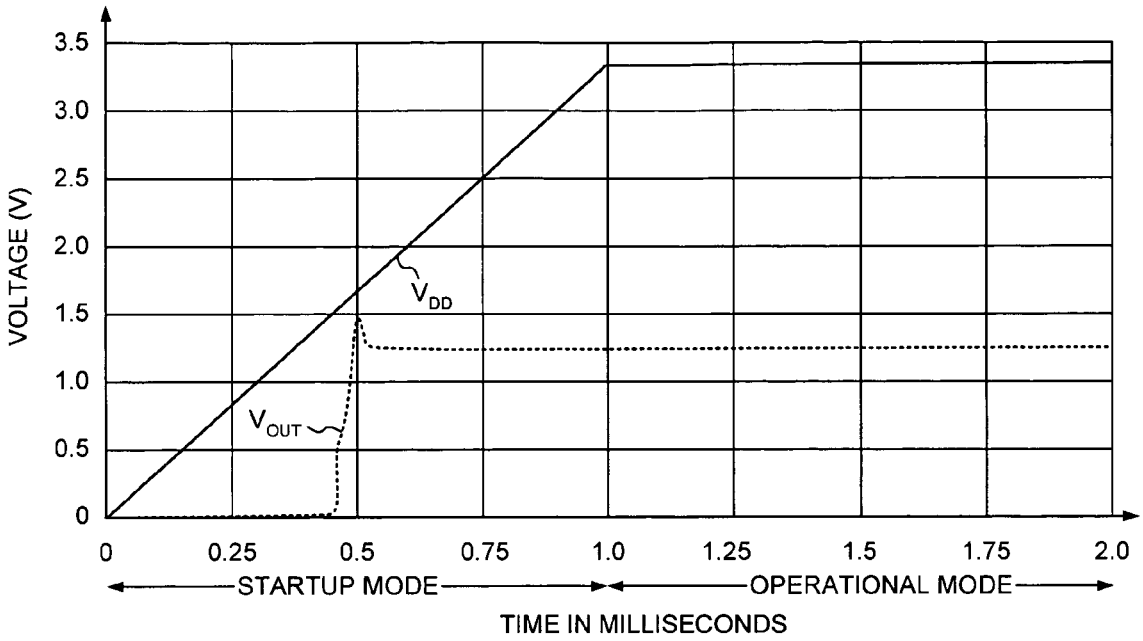
FIG. 5 is a waveform diagram showing the relationship between the supply voltage $V_{DD}$ and the reference voltage $V_{OUT}$ output as the bandgap reference circuit of FIG. 3 biases up.

FIG. 5 is a voltage waveform diagram showing the relationship between supply voltage $V_{DD}$ and reference voltage $V_{OUT}$ output as BGR circuit 20 "biases up." In this embodiment, resistor $R_4$ is adjusted so that reference voltage $V_{OUT}$ is about 1.25 volts in normal operation. Although supply voltage $V_{DD}$ continues to rise from about 1.6 volts at about 0.5 milliseconds to about 3.4 volts at about 1.0 milliseconds, $V_{OUT}$ stabilizes at about 1.25 volts shortly after about 0.5 milliseconds. BGR circuit 20 operates in startup mode until about 1.0 milliseconds when $V_{DD}$ levels off, at which time BGR circuit 20 switches to the operational mode.

Returning to FIG. 3, resistor $R_4$ is comprised of a string of resistor portions 43–49. In one embodiment, some resistor portions are themselves comprised of multiple resistor components. In one example, resistor portion 43 comprises forty-seven closed transistors coupled in series. The magnitude of resistor $R_4$ is adjusted by bypassing certain resistor portions by closing certain of switches 50–55. In one embodiment, switches 50–55 are NMOS transistors that are controlled by digital signals $B_2$–$B_7$, respectively. For example, to achieve a resistance only through resistor portions 43–47 but not through resistor portions 48–49, signals $B_2$–$B_3$ are asserted, and signals $B_4$–$B_7$ are deasserted. Thus, switches 52–55 remain open, and switches 50–51 are closed, bypassing resistor portions 48–49.

In one embodiment, BGR circuit 20 is part of a microcontroller that also includes an analog-to-digital converter. Output reference voltage $V_{OUT}$ is used to calibrate the internal reference of the analog-to-digital converter. The level of reference voltage $V_{OUT}$ output by BGR circuit 20 is programmable and is adjusted by the microcontroller asserting signals $B_2$–$B_7$ in a predetermined manner. In another embodiment, BGR circuit 20 is part of a 1.8-volt core memory cell, and output reference voltage $V_{OUT}$ is programmed to be a voltage significantly below the bandgap voltage of silicon.

Bandgap reference circuits typically have stable operating points at their final operating points, as well as at voltages of $V_A$ and $V_B$ that correspond to no current flowing through their components. Typical bandgap reference circuits therefore have startup circuits that prevent only the condition where no current flows across the p-n junctions of diode-connected transistors. BGR circuit 20, however, has more than two incorrect operating points that can become stable operating points, including points at which some current flows across the p-n junctions.

Figure 6:
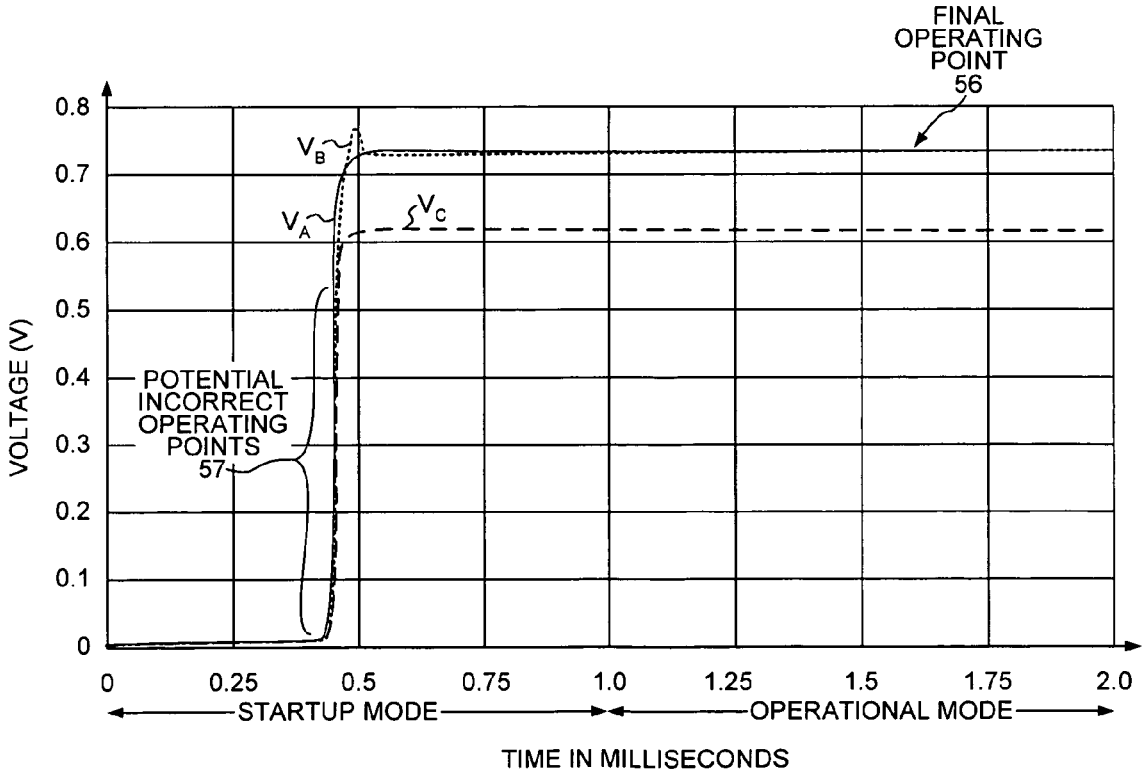

FIG. 6 is a voltage waveform diagram showing how voltages $V_A$, $V_B$ and $V_C$ respond over time as the supply voltage $V_{DD}$ increases and BGR circuit 20 biases up. The period in FIG. 6 corresponds to the period in FIG. 5 over which $V_{OUT}$ varies in relation to $V_{DD}$. In the example of FIG. 6, voltages $V_A$ and $V_B$ achieve a final operating point 56 of about 7.3 volts within less than about one millisecond from power on. At the final operating point, the difference between voltage $V_B$ and voltage $V_C$ is about 100 mV. Thus, $dV_F$ is about 100 mV during normal operation in the operational mode. At around 0.5 milliseconds from power on, operational amplifier 25 detects that voltage $V_A$ does not equal voltage $V_B$ and increases currents $I_4$ and $I_5$ until voltage $V_A$ equals voltage $V_B$.

In a region of potential incorrect operating points 57 before about 0.5 milliseconds from power on, however, operational amplifier 25 does not detect that voltages $V_A$ and $V_B$ have not achieved final operating point 56 if voltages $V_A$ and $V_B$ do not diverge. Without startup control loop 21, the reference voltage $V_{OUT}$ output by BGR circuit 20 would not correspond as expected to the equation $$V_{OUT}=R_4([(kT/qR_3)ln(48)]+[(kT/qR_2)ln(I_{1A}/I_S)])$$

as derived in FIG. 4, even though voltages $V_A$ and $V_B$ would be substantially equal. Without startup current generator 22 to force sufficient current through diodes $D_1$ and $D_2$, BGR circuit 20 might stabilize at an incorrect operating point in region 57. After startup current generator 22 forces current through diodes $D_1$ and $D_2$, BGR circuit 20 maintains $V_{F1}$ across diode $D_1$ equal to the sum of $V_{F2}$ across diode $D_2$ plus $dV_F$ across resistor $R_3$.

$V_{F1}$, $V_{F2}$ and $dV_F$ all equal about zero volts during startup and before appreciable current flows through diodes $D_1$ and $D_2$. During this period, substantially all of first current $I_1$ flows through resistor $R_1$, and substantially all of second current $I_2$ flows through resistor $R_2$. Before appreciable current flows through diodes $D_1$ and $D_2$, $V_A$ equals $V_B$ because $V_A=I_1 \cdot R_1$, $V_B=I_2 \cdot R_2$, $I_1=6I_2$ and $6R_1=R_2$. In the startup mode, startup current generator 24 forces current through diodes $D_1$ and $D_2$ and thereby prevents BGR circuit 20 from stabilizing at an incorrect operating point within region 57 when $V_{F1}$, $V_{F2}$ and $dV_F$ all equal about zero volts.

As shown in FIG. 3, startup control loop 21 includes an operational amplifier 58 that has 55 mV of input offset. Voltage $V_B$ is present on a noninverting input lead 59 of operational amplifier 58. Voltage $V_C$ is present on an inverting input lead 60 of operational amplifier 58. Operational amplifier 58 generates a voltage $V_E$ that turns on two PMOS transistors 61 and 62 when $dV_F$ across resistor $R_3$, which equals $V_B$–$V_C$, is less than about 55 mV. In the startup mode, when $dV_F$ is less than 55 mV, sixth current $I_6$ and seventh current $I_7$ flow through transistors 61 and 62, respectively. Startup control loop 21 generates current $I_7$ with a magnitude that results in current $I_{2A}$ through resistor $R_3$ having a magnitude of 55 mV/$R_3$. The magnitude of current $I_{2A}$ at which second diode $D_2$ is placed "in conduction" is about half the magnitude of current $I_{2A}$ under normal operating conditions, which is about 100 mV/$R_3$.

Figure 7:
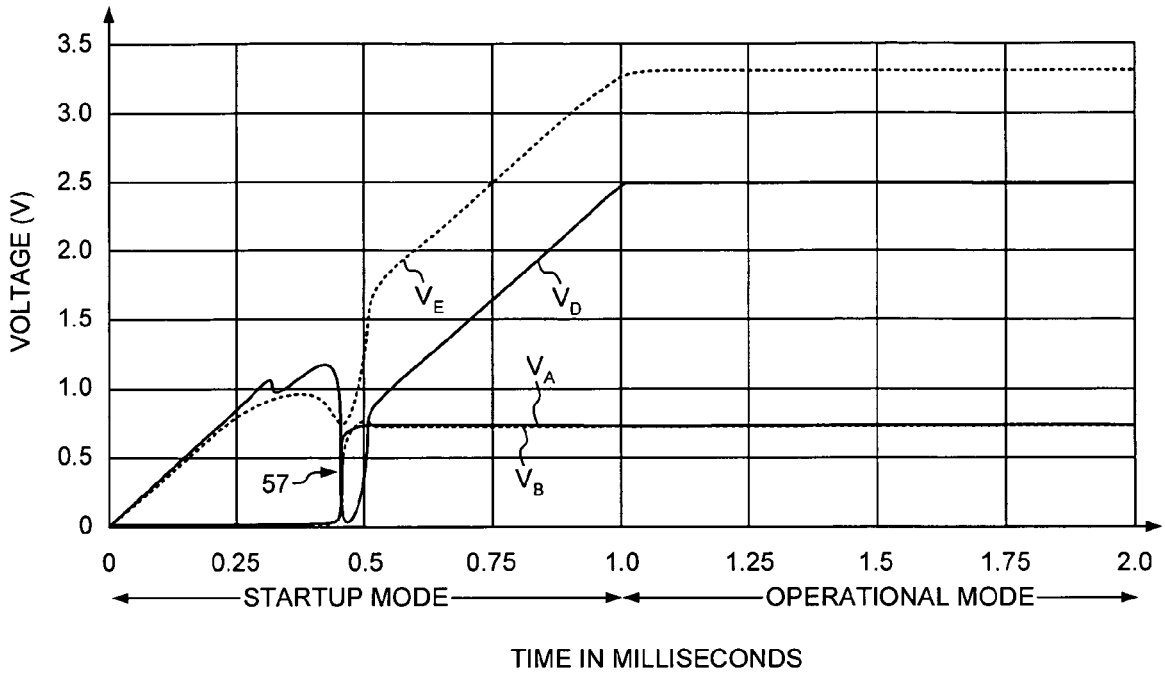
FIG. 7 is a waveform diagram showing the response of two internal voltages output by two operational amplifiers as the bandgap reference circuit of FIG. 3 biases up.

FIG. 7 is a voltage waveform diagram showing the response over time of voltage $V_D$ output by operational amplifier 25 and of voltage $V_E$ output by operational amplifier 58. As voltage $V_E$ increases to about 3.4 volts, transistors 61 and 62 gradually turn off, and currents $I_6$ and $I_7$ cease flowing. Voltage $V_D$ stabilizes at about 2.5 volts in the operational mode, which allows sufficient magnitudes of currents $I_1$ and $I_2$ to pass through transistors 28–31 so as to maintain voltage $V_A$ substantially equal to voltage $V_B$. FIG. 7 shows that up to and including the region of potential incorrect operating points 57 (as labeled in FIG. 6), where operational amplifier 25 does not yet detect a difference in the voltages $V_A$ and $V_B$, voltage $V_D$ output by operational amplifier 25 continues to rise, gradually turning off transistors 28–31. Around region 57, startup control loop 21 detects that $dV_F$ is less than 55 mV and thereupon decreases voltage $V_E$ and increases currents $I_6$ and $I_7$. Currents $I_{1A}$ and $I_{2A}$ begin to flow through diodes $D_1$ and $D_2$ causing voltages $V_A$ and $V_B$ to diverge. As voltages $V_A$ and $V_B$ diverge, main current control generator 23 drops voltage $V_D$ to almost zero volts. Transistors 28–31 turn on fully, and currents $I_1$ and $I_2$ increase dramatically. After the elapse of about 0.5 milliseconds, voltage $V_D$ increases and currents $I_1$ and $I_2$ are then reduced and stabilize at a magnitude where $dV_F$ is maintained at about 100 mV.

Startup control loop 21 has a gain of about 50 dB and about 69 degrees of phase margin, whereas the main feedback control loop that includes main control current generator 23 has a gain of about 85 dB and about 62.5 degrees of phase margin. Therefore, as main control current generator 23 begins to generate current after the region of potential incorrect operating points 57, startup control loop 21 is overpowered by currents $I_4$ and $I_5$.

Figure 8:
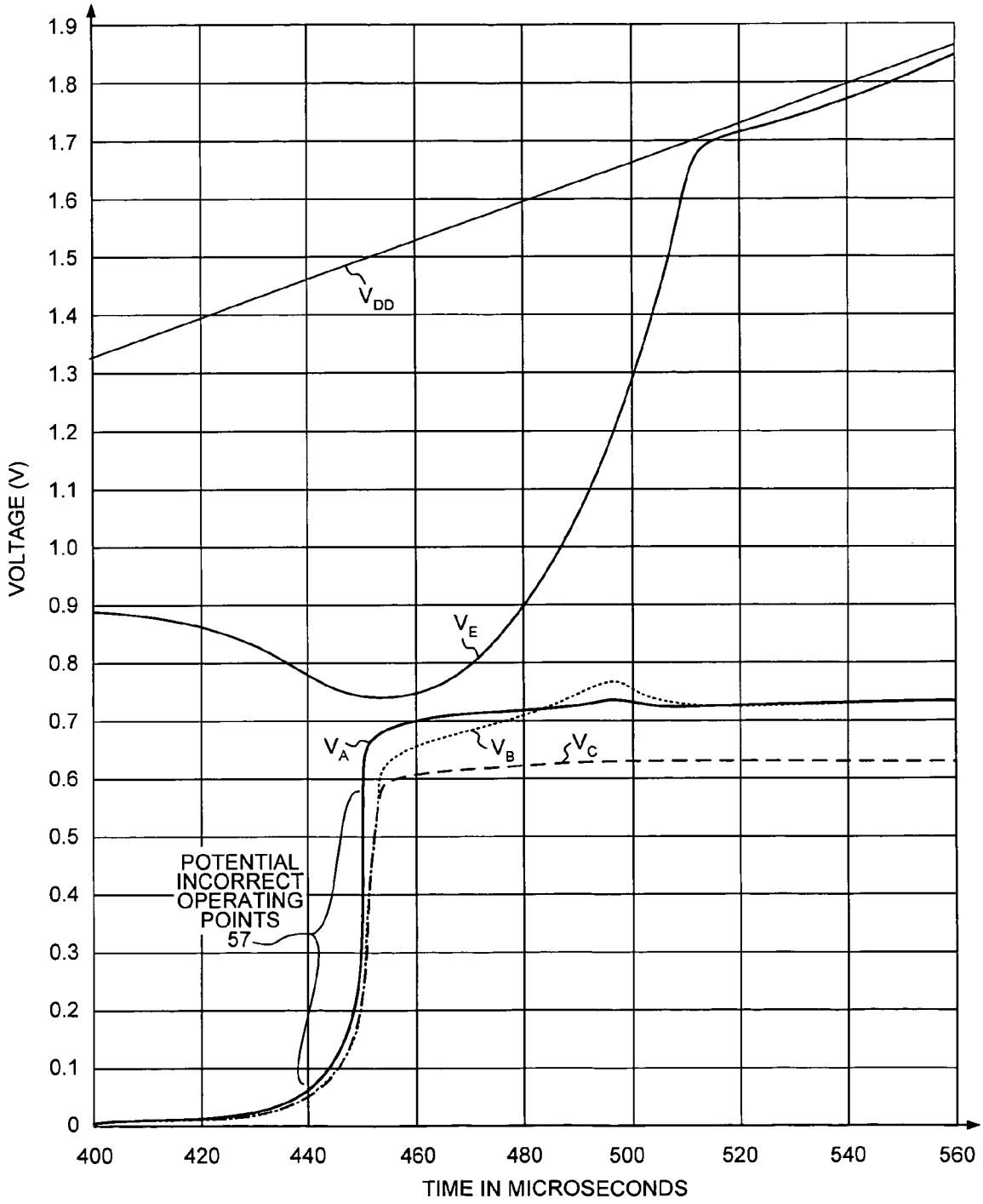
FIG. 8 is a more detailed waveform diagram showing the relationship between the supply voltage $V_{DD}$ and the internal voltages shown in FIGS. 6 and 7.

FIG. 8 is a voltage waveform diagram showing the response of the voltages $V_A$, $V_B$, $V_C$ and $V_E$ in more detail as the supply voltage $V_{DD}$ of BGR circuit 20 increases over a narrower time period around region 57 of FIG. 6. FIG. 8 shows that startup control loop 21 prevents voltage $V_A$ from equaling $V_B$ in region 57. When voltage $V_E$ output by operational amplifier 58 decreases from about 400 microseconds to about 450 microseconds from power on, currents $I_6$ and $I_7$ increase and voltages $V_A$ and $V_B$ diverge. In this example, voltage $V_E$ tracks the increase in supply voltage $V_{DD}$ after voltages $V_A$ and $V_B$ converge at their final operating point at around 510 microseconds. Startup current generator 23 nevertheless continues to generate some amount of current $I_6$ and current $I_7$ until the startup mode ends at around one millisecond from power on and transistors 61 and 62 are completely turned off.

Figure 9:
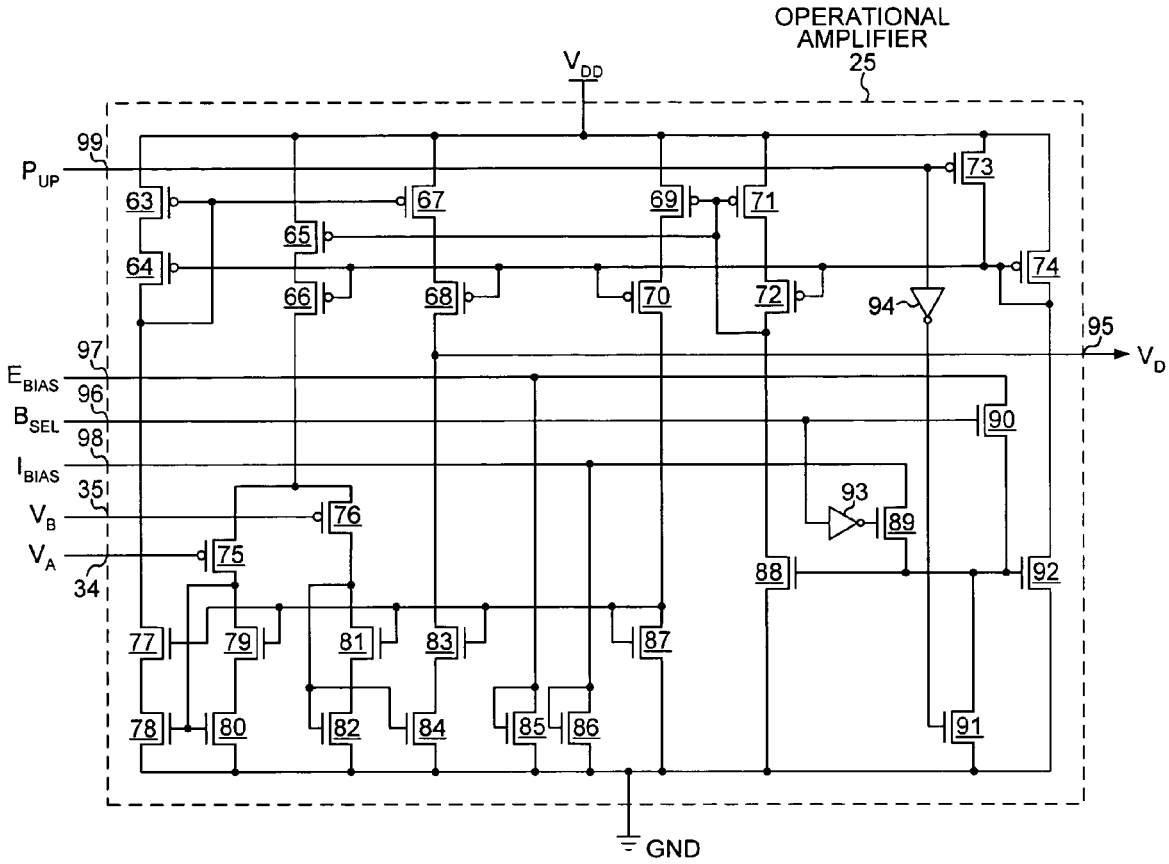
FIG. 9 is a more detailed schematic diagram of an operational amplifier in a main control current generator of the bandgap reference circuit of FIG. 3.

FIG. 9 is a circuit diagram showing operational amplifier 25 of main control current generator 23 in more detail. Operational amplifier 25 includes fourteen PMOS transistors 63–76, sixteen NMOS transistors 77–92 and two inverters 93–94. Transistor 75 is coupled to inverting input lead 34, and transistor 76 is coupled to noninverting input lead 35. Based on the voltages $V_A$ and $V_B$ present on input leads 34 and 35, respectively, operational amplifier 25 outputs voltage $V_D$ onto an output lead 95. An external bias select signal ($B_{SEL}$) is present on an input lead 96. $B_{SEL}$ is used to select between an internal bias current $I_{BIAS}$ generated by bias generator 26 and an external bias current source. The external bias current $E_{BIAS}$ is present on an input lead 97. Internal bias current $I_{BIAS}$ is received from bias generator 26 on an input lead 98. When $B_{SEL}$ is deasserted, BGR circuit 20 uses the internal bias current $I_{BIAS}$, and the external bias current $E_{BIAS}$ is not used. A power up signal $P_{UP}$ is present on an input lead 99 and is used to power up BGR circuit 20 when supply voltage $V_{DD}$ is always on. In another embodiment, BGR circuit 20 powers up when voltage $V_{DD}$ is turned on.

Figure 10:
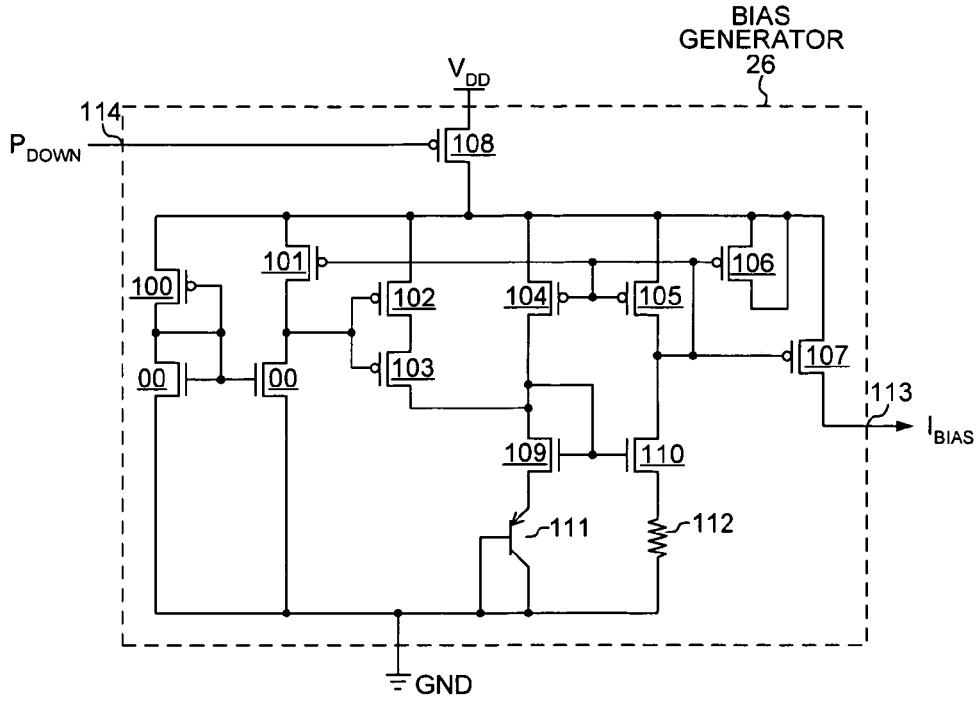
FIG. 10 is a more detailed schematic diagram of a bias current generator in the main control current generator of the bandgap reference circuit of FIG. 3.

FIG. 10 is a circuit diagram of bias generator 26. Bias generator 26 includes nine PMOS transistors 100–108, two NMOS transistors 109–110, a bipolar transistor 111 and a resistor 112. Bias generator 26 outputs internal bias current $I_{BIAS}$ onto an output lead 113. Bias generator 26 is powered down by asserting a power down signal $P_{DOWN}$ that is received on an input lead 114.

Figure 11:
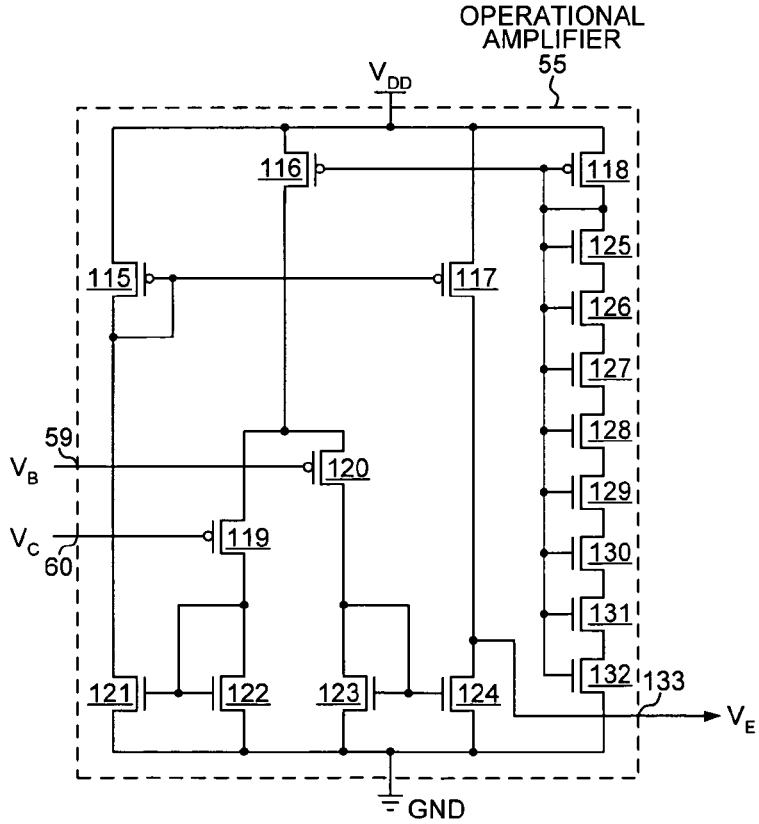
FIG. 11 is a more detailed schematic diagram of an operational amplifier in a startup current generator of the bandgap reference circuit of FIG. 3.

FIG. 11 is a circuit diagram showing operational amplifier 55 of startup current generator 24 in more detail. Operational amplifier 55 includes six PMOS transistors 115–120 and twelve NMOS transistors 121–132. Transistor 119 is coupled to inverting input lead 60, and transistor 120 is coupled to noninverting input lead 59. Based on the voltages $V_B$ and $V_C$ present on input leads 59 and 60, respectively, operational amplifier 55 outputs voltage $V_E$ onto an output lead 133.

Although the present invention has been described in connection with certain specific embodiments for instructional purposes, the present invention is not limited thereto. Although the voltage drops $V_{F1}$ and $V_{F2}$ are described above as the voltages across the p-n juctions of diodes, BGR circuit 20 is configured in other embodiments such that the voltages $V_{F1}$ and $V_{F2}$ are voltage drops across p-n junctions of bipolar, NMOS or PMOS transistors that are not diode connected. Accordingly, various modifications, adaptations, and combinations of various features of the described embodiments can be practiced without departing from the scope of the invention as set forth in the claims.

What is claimed is:

1. A device comprising:

a current generator that generates a first current with a first magnitude and a second current with a second magnitude, wherein the first magnitude is a fixed multiple of the second magnitude, wherein the current generator comprises a main control current generator and a startup current generator;

a p-n junction having a node, wherein the first current passes through the p-n junction, and wherein a first voltage is present on the node of the p-n junction; and a resistor with a first node and a second node, wherein the second current passes through the resistor, wherein a second voltage is present on the first node and a third voltage is present on the second node, wherein the main control current generator controls the first magnitude and the second magnitude such that the first voltage equals the second voltage, and wherein the startup current generator increases the first magnitude and the second magnitude when the second voltage exceeds the third voltage by less than a predetermined voltage offset.

2. The device of claim 1, wherein the startup current generator comprises an operational amplifier that detects when the second voltage exceeds the third voltage by less than the predetermined voltage offset.

3. The device of claim 1, wherein the p-n juction has a negative temperature coefficient.

4. The device of claim 1, wherein the main control current generator comprises a current mirror.

5. The device of claim 1, further comprising:

a second p-n junction having a node, wherein the node of the second p-n junction is coupled to the second node of the resistor.

6. The device of claim 1, wherein the p-n junction has a temperature, and wherein the first voltage remains substantially constant as the temperature of the p-n junction varies.

7. A method comprising:

(a) in a startup mode, generating a startup current and a second current in a bandgap reference circuit, wherein the bandgap reference circuit comprises a resistor having a first node and a second node, wherein a first voltage is present on the first node and a second voltage is present on the second node, wherein the startup current flows through the resistor when the first voltage exceeds the second voltage by less than a predetermined voltage offset; and (b) in an operational mode, generating the second current, wherein the second current flows through the resistor, wherein the bandgap reference circuit has a temperature, and wherein the first voltage remains substantially constant as the temperature of the bandgap reference circuit varies.

8. The method of claim 7, wherein the startup current is not generated in the operational mode.

9. The method of claim 7, wherein a diode is coupled in series to the resistor, and wherein in the startup mode the startup current passes through the resistor and the diode.

10. The method of claim 7, wherein the generating the startup current in (a) is performed using an operational amplifier.

11. The method of claim 7, further comprising:

(c) in the startup mode, generating a second startup current when the first voltage exceeds the second voltage by less than the predetermined voltage offset, wherein the startup current has a first magnitude and the second startup current has a second magnitude, and wherein the first magnitude is a fixed multiple of the second magnitude.

12. The method of claim 11, wherein the second startup current passes through a diode.

13. A method comprising:

(a) generating a first current with a first magnitude and a second current with a second magnitude, wherein the first magnitude is a fixed multiple of the second magnitude;

(b) passing the first current through a p-n junction having a node, wherein a first voltage is present on the node of the p-n junction;

(c) passing the second current through a resistor, wherein a second voltage is present on a first node of the resistor, and a third voltage is present on a second node of the resistor;

(d) detecting a difference between the second voltage and the third voltage;

(e) increasing the first magnitude and the second magnitude when the difference between the second voltage and the third voltage is less than a predetermined voltage offset; and (f) controlling the first magnitude and the second magnitude until the first voltage substantially equals the second voltage.

14. The method of claim 13, wherein the p-n junction is part of a diode.

15. The method of claim 13, wherein the second node of the resistor is coupled to a second p-n junction.

16. The method of claim 13, wherein the increasing in (e) is performed using an operational amplifier.

17. The method of claim 13, wherein the generating in (a) is performed using a current mirror.

18. The method of claim 13, further comprising:

(g) generating an output voltage, wherein the p-n junction has a temperature, and wherein the output voltage remains substantially constant as the temperature of the p-n junction varies.

19. A device comprising:

a bandgap reference circuit that generates a reference voltage, wherein the bandgap reference circuit has a resistor with a first node and a second node, wherein a first voltage is present on the first node and a second voltage is present on the second node, wherein the bandgap reference circuit has a p-n junction, wherein a third voltage is present on a node of the p-n junction, wherein the bandgap reference circuit has an operating point when the first voltage substantially equals the third voltage; and means for preventing the bandgap reference circuit from operating at the operating point when the first voltage exceeds the second voltage by less than a predetermined voltage offset.

20. The device of claim 19, wherein the means generates a startup current when the first voltage exceeds the second voltage by less than the predetermined voltage offset.

21. The device of claim 19, wherein the bandgap reference circuit has a temperature, and wherein the reference voltage remains substantially constant as the temperature of the bandgap reference circuit varies.

* * * * *